US008903112B2

(12) United States Patent
Lu et al.

(10) Patent No.: US 8,903,112 B2
(45) Date of Patent: Dec. 2, 2014

(54) BATTERY DOOR AND HEARING DEVICE

(71) Applicants: Dongmei Lu, Taastrup (DK); Jens Sparre Kobbernagel, Copenhagen N (DK); Philip Meinertz, Gentofte (DK)

(72) Inventors: Dongmei Lu, Taastrup (DK); Jens Sparre Kobbernagel, Copenhagen N (DK); Philip Meinertz, Gentofte (DK)

(73) Assignee: GN Resound A/S, Ballerup (DK)

( * ) Notice: Subject to any disclaimer, the term of this patent is extended or adjusted under 35 U.S.C. 154(b) by 0 days.

(21) Appl. No.: 13/772,092

(22) Filed: Feb. 20, 2013

(65) Prior Publication Data

US 2014/0177893 A1 Jun. 26, 2014

(30) Foreign Application Priority Data

Dec. 21, 2012 (DK) ..... 2012 70819
Dec. 21, 2012 (EP) ..... 12199096

(51) Int. Cl.
*H04R 25/00* (2006.01)

(52) U.S. Cl.
CPC ..... *H04R 25/65* (2013.01); *H04R 2225/021* (2013.01); *H04R 25/602* (2013.01); *H04R 25/556* (2013.01)
USPC ..... 381/323; 381/322; 381/330

(58) Field of Classification Search
CPC .... H04R 25/602; H04R 25/65; H04R 25/556; H04R 2225/021; H04R 2225/31; H04R 222/61; H04R 2225/63; H04R 25/554; H04R 25/60
USPC ..... 381/314, 322, 323, 324, 327, 330, 381
See application file for complete search history.

(56) References Cited

U.S. PATENT DOCUMENTS

| | | | | |
|---|---|---|---|---|
| 2007/0081686 | A1 | 4/2007 | Sluppke | |
| 2010/0290655 | A1 * | 11/2010 | Takeda et al. | 381/323 |
| 2013/0004003 | A1 * | 1/2013 | Tada | 381/323 |

FOREIGN PATENT DOCUMENTS

| | | | |
|---|---|---|---|
| DE | 19601231 | A1 | 7/1997 |
| DE | 10 2010 040 930 | A1 | 3/2012 |
| EP | 0674465 | A1 | 9/1995 |
| EP | 2 528 138 | A1 | 11/2012 |
| WO | 2008/110210 | A1 | 9/2008 |
| WO | 2009/120148 | A1 | 10/2009 |
| WO | 2010/108543 | A1 | 9/2010 |
| WO | 2012/034815 | A1 | 3/2012 |

OTHER PUBLICATIONS

Extended European Search Report dated Mar. 21, 2013 for EP Patent Application No. 121999096.4, 8 pages.
First Technical Examination and Search Report dated May 8, 2013 for related Danish Patent Application No. PA 2012 70819, 5 pages.
Second Technical Examination and Search Report dated Dec. 17, 2013 for related Danish Patent Application No. PA 2012 70819, 6 pages.

* cited by examiner

*Primary Examiner* — Huyen D Le
(74) *Attorney, Agent, or Firm* — Vista IP Law Group, LLP

(57) ABSTRACT

A battery door for a hearing device includes: a body having a bottom part and a sidewall, the bottom part having a first bottom surface and the sidewall having a first wall surface, the first wall surface comprising contact points for supporting a battery with a battery radius, wherein the first bottom surface and the first wall surface at least partly defines a battery compartment for housing the battery with the battery axis, wherein the contact points of the first wall surface arranged at a battery distance from the battery axis, and wherein a center axis perpendicularly crosses the pivoting axis and crosses the battery axis.

15 Claims, 5 Drawing Sheets

BATTERY DOOR AND HEARING DEVICE

RELATED APPLICATION DATA

This application claims priority to and the benefit of Danish Patent Application No. PA 2012 70819, filed on Dec. 21, 2012, pending, and European Patent Application No. 12199096.4, filed on Dec. 21, 2012, pending. The disclosures of both of the above applications are expressly incorporated by reference herein.

FIELD

The present of the application relates to a battery door for a hearing device and a hearing device comprising a battery door.

BACKGROUND

A focus in the hearing aid industry is to make hearing aids smaller and more discrete for the benefit of the user and thus a design which can decrease the size of the hearing aid is of importance. Further, it is of great interest from a cost perspective that designs are easy and cheap to manufacture. Generally a button battery is used in a hearing device and traditionally a battery door of a hearing aid has been fitted with a locking mechanism, e.g. operated by a small slider or relying on a spring effect of the material, leading to bulky hearing devices a complex manufacturing process and/or high failure rate of the locking mechanism.

SUMMARY

Despite the known solutions, there is still a need for reducing the size of a hearing device and components or parts thereof.

Accordingly, a battery door for a hearing device is provided, the battery door comprising a body with at least one pivoting element for coupling the battery door to a hearing device housing such that the battery door is configured to pivot about a pivoting axis. The body has a bottom part and a sidewall. The bottom part has a first bottom surface and the sidewall has a first wall surface, the first wall surface comprising contact points for supporting a battery with a battery radius, wherein the first bottom surface and the first wall surface at least partly defines a battery compartment with a battery axis and contact points of the first wall surface arranged at a battery distance from the battery axis. A center axis perpendicularly crosses the pivoting axis and crosses the battery axis. The battery door further comprises a first locking element and a second locking element. The first locking element and/or the second locking element may be arranged in the bottom part of the body.

A hearing device comprising a housing and a battery door as described is disclosed, wherein the hearing device comprises at least one engagement member configured to engage with the first and second locking element of the battery door, when the battery door is in a first and second position, respectively.

The disclosed battery door is advantageous in that it decreases the space needed for the locking mechanism, thus facilitating a small hearing device and a small battery door. Furthermore, due to a simplification of the locking mechanism, a battery door that is simple to manufacture and has reduced requirements to material quality is provided, resulting in reduced costs and reduced failure rates.

A battery door for a hearing device, the battery door includes: a body with at least one connection for rotatably coupling the battery door to a hearing device housing such that the battery door is configured to pivot about a pivoting axis, the body having a bottom part and a sidewall, the bottom part having a first bottom surface and the sidewall having a first wall surface, the first wall surface comprising contact points for supporting a battery with a battery radius, wherein the first bottom surface and the first wall surface at least partly defines a battery compartment for housing the battery with the battery axis, wherein the contact points of the first wall surface arranged at a battery distance from the battery axis, and wherein a center axis perpendicularly crosses the pivoting axis and crosses the battery axis; a first locking element at the bottom part of the body; and a second locking element at the bottom part of the body.

Optionally, the first locking element is at a first distance from the battery axis, the first distance being less than the battery distance.

Optionally, the second locking element is at a second distance from the battery axis, the second distance being less than the battery distance.

Optionally, the second distance is less than the first distance.

Optionally, the first locking element is arranged on a straight first axis perpendicularly crossing the pivoting axis, and the second locking element being arranged on a straight second axis perpendicularly crossing the pivoting axis, and wherein a first angle between the center axis and the first axis is anywhere from −20° to 20° and a second angle between the center axis and the second axis is anywhere from −20° to 20°.

Optionally, the first angle is anywhere from −10° to 10°, and the second angle is anywhere from −10° to 10°.

Optionally, the first angle is larger than 0°, and the second angle is less than 0°.

Optionally, an angle between the second axis and the first axis is anywhere from 5° to 20°.

Optionally, the first locking element comprises a first recess in the first bottom surface, the first recess extending radially inward.

Optionally, the second locking element comprises a second recess in the first bottom surface, the second recess extending radially inward.

Optionally, the bottom part has a first cutout section, the first cutout section extending to a second wall surface of the sidewall.

Optionally, the bottom part has a second cutout section.

Optionally, the bottom part comprises an arc-shaped bridge element, and the first locking element and the second locking element are at an outer edge of the bridge element.

Optionally, the bottom part comprises a first arm element, and the first locking element is at an outer edge of the first arm element.

A hearing device includes the hearing device housing and the battery door according to any of the above features.

Optionally, the hearing device also includes at least one engagement member configured to engage with the first and second locking elements of the battery door when the battery door is in a first and second position, respectively.

Optionally, the hearing device also includes an electrical connector placed inside the hearing device housing, wherein the electrical connector is connectable to a bottom of the battery when the battery is placed in the battery compartment of the battery door and upon closing of the battery door.

Other and further aspects and features will be evident from reading the following detailed description of the embodiments.

BRIEF DESCRIPTION OF THE DRAWINGS

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings depict only exemplary embodiments and are not therefore to be considered limiting in the scope of the claims.

DETAILED DESCRIPTION

Figure 1:
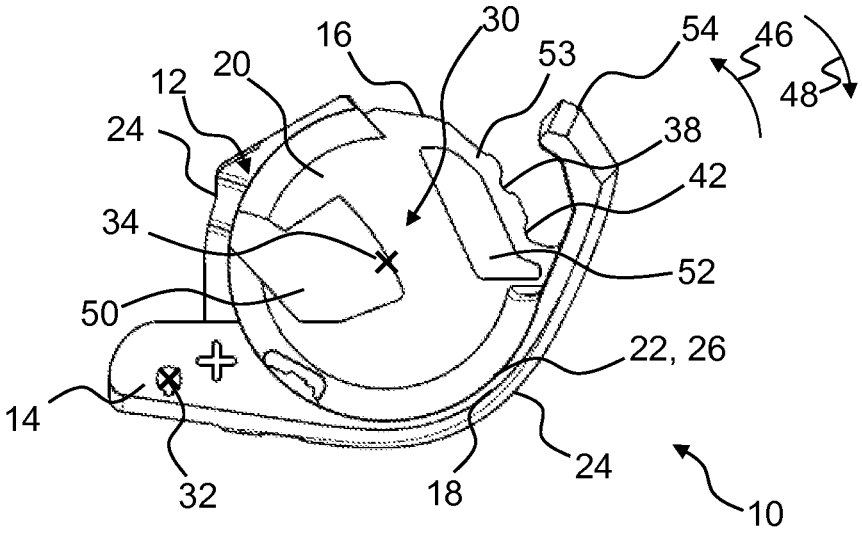
FIG. 1 schematically illustrates an exemplary battery door according to some embodiments, FIG. 2 schematically illustrates an exemplary battery door with exemplary important angles, FIG. 3 schematically illustrates an exemplary battery door with exemplary important distances.

Various embodiments are described hereinafter with reference to the figures. It should be noted that the figures are not necessarily drawn to scale and that elements of similar structures or functions are represented by like reference numerals throughout the figures. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

A positive angle between the center axis and an axis is an angle from the center axis to the respective axis in the intended closing direction of the battery door.

A negative angle between the center axis and an axis is an angle from the center axis to the respective axis in the intended opening direction of the battery door.

The battery distance is measured perpendicular to the battery axis.

The body has a first end and a second end. Typically, the battery is inserted into the battery compartment through an opening in the first end along the battery axis.

The bottom part of the body is the part of the body between the first bottom surface and the second end.

The first locking element may be arranged in the bottom part at a first distance from the battery axis. The first distance may be less than the battery distance. The second locking element may be arranged in the bottom part at a second distance from the battery axis. The second distance may be less than the battery distance. In a prefered battery door, the first distance and the second distance are both less than battery distance. As a consequence the locking mechanism of the battery door is an integrated part of the bottom part, located underneath the battery when inserted, facilitating a battery door with reduced size. The second distance may be less than the first distance. The second distance may be larger than the first distance.

The first locking element may be arranged on a first straight axis perpendicularly crossing the pivoting axis, wherein a first angle between the center axis and the first axis may be in the range from −20° to 20°. The first angle may be in the range from −10° to 10°. The first angle may be larger than 0°

The second locking element may be arranged on a second straight axis perpendicularly crossing the pivoting axis, wherein a second angle between the center axis and the second axis may be in the range from −20° to 20°. The second angle may be in the range from −10° to 10°. The second angle may be less than 0°.

The smallest angle between the first axis and the second axis is denoted the third angle. The numerical value of the third angle may be in the range from 5° to 30°, e.g. in the range from 5° to 20°. In an exemplary battery door, the numerical value of the third angle is in the range from 6° to 15°, e.g. 8°. The third angle must be large enough to facilitate a tactile difference between the first and second positions. On the other hand, a small angle may be desired to facilitate a compact design and prevent the battery door from being too open in a first position.

The locking elements may comprise one or more recesses in the bottom surface. A recess may extend in any direction and may be in one direction in the first locking element and another in the second locking element. The locking element(s) may each comprise one or more recesses extending radially inward towards the battery axis. Thereby a compact design is facilitated preventing the locking mechanism from taking up excess space.

The bottom part may have a first cutout section. The first cutout section may extend to a second wall surface or outer surface of the sidewall, such that an electrical connector placed inside the housing of the hearing aid engages with the bottom of a battery placed in the battery door when a user closes the battery door by pivoting the battery door in the closing direction.

To provide a certain amount of flexibility to the locking elements, the bottom part may also have a second cutout section. The second cutout may be located such that the bottom part comprises an arc-shaped bridge element. The first locking element and/or the second locking element may be formed on an outer edge of the bridge element. The thickness of the bridge element is to be determined by the specific material in use and should be thin enough to provide enough flexibility for an engagement member of the hearing aid to engage with the locking elements and thick enough to prevent the bridge element from breaking due to wear and tear.

The second cutout section may be an open cutout forming at least a first arm element in the bottom part. The first arm element may point in the opening or the closing direction. The second cutout may form a second arm element in the bottom part. The first locking element and the second locking element may be formed in the first arm element. In an exemplary battery door, the first locking element is formed in the first arm element and the second locking element is formed in the second arm element. An arm element facilitates greater flexibility, but also dictates a higher demand to strength of the material. In an exemplary battery door, one of the locking elements, e.g. the first locking element, may be located on the first arm element while the other locking element, e.g. the second locking element, is formed as part of a cutout.

FIG. 1 shows a top view of an exemplary battery door 10 for a hearing device. The battery door 10 comprises a body 12 with at least one pivoting element 14 for coupling the battery door 10 to the hearing device such that the battery door 10 is configured to pivot about a pivoting axis 32. The body may comprise first and second pivoting elements with bores for accomodating a rod or pin to pivot the body 12 about the rod/pin forming the pivoting axis 32. The body 12 has a bottom part 16 and a sidewall 18, the bottom part 16 having a first bottom surface 20 and the sidewall having a first wall surface 22 and a second wall surface 24. The first wall surface comprises contact points and/or contact surfaces (26) for supporting a battery 28 with a battery radius $R_{bat}$ (see FIG. 4) The first bottom surface 20 and the first wall surface 22 at least partly defines a battery compartment 30 with a battery axis 34 and contact points of the first wall surface 22 arranged at a battery distance $R_1$ (see FIG. 3) from the battery axis 34. Further, the battery door 10 comprises a first locking element 38 formed as a first recess extending radially inward (perpendicular to the battery axis) in the bottom part 16. Further, the battery door 10 comprises a second locking element 42 formed as a second recess extending radially inward (perpendicular to the battery axis) in the bottom part 16.

The bottom part 16 has a first cutout 50 extending to the second wall surface 24, such that an electrical connector arranged inside the housing of the hearing aid is connectable to a bottom of a battery placed in the battery door by pivoting the battery door about the pivot axis 32. The battery bottom of a battery is the battery surface facing the bottom part. The bottom part 16 has a second cutout 52 forming a bridge element 53 in the bottom part, and wherein the first locking element 38 and the second locking element 42 are formed on an outer edge of the bridge element. The bridge element 53 is flexible and allows the bridge element 53 with the first and second locking elements to move during opening and closing of the battery door, such that the first and second locking elements can engage with engagement member(s) of a hearing device housing in first and second positions, respectively. The user opens the battery door 10 by pushing the tip of the handle element 54 in the opening direction 48. Closing the battery door is achieved by pushing the body 12 or the handle element 54 in the closing direction 46.

Figure 2:
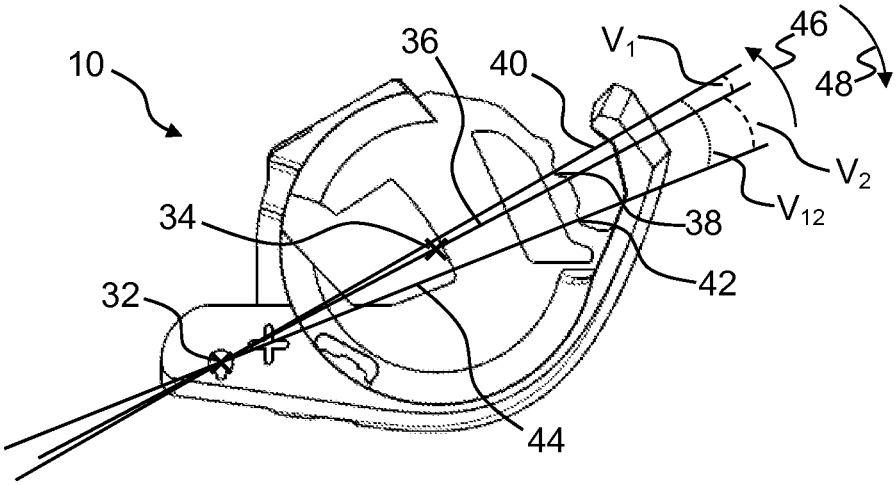

FIG. 2 shows a top view of the battery door 10 with indication of the center axis, first axis and second axis. A center axis 36 perpendicularly crosses the pivoting axis 32 and crosses the battery axis 34. A first axis 40 perpendicularly crosses the pivoting axis 32 and crosses the first locking element 38. A second axis 44 perpendicularly crosses the pivoting axis 32 and crosses the second locking element 42. The angle between the center axis 42 and the first axis 40 and the angle between the center axis 42 and the second axis 44, are denoted as $V_1$ and $V_2$ respectively. A positive angle between the center axis 42 and an axis is an angle from the center axis 42 to the respective axis in the intended closing direction 46 of the battery door 10. A negative angle between the center axis 42 and an axis is an angle from the center axis 42 to the respective axis in the intended opening direction 48 of the battery door 10. Also shown is the third angle between the second axis and the first axis, denoted $V_{12}$. In the example shown, $V_1$ is 2°, $V_2$ is −6° and $V_{12}$ is therefore 8°, thus providing a good balance between compact design and tactile impression between the first position and the second position.

Figure 3:
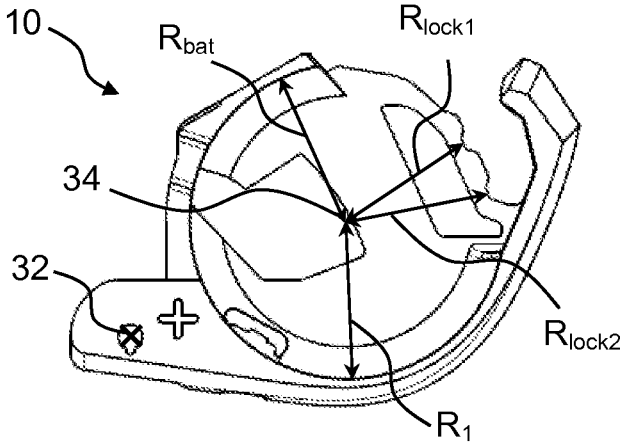

FIG. 3 shows a top view of an exemplary battery door 10 with indication of distances. A first distance from the battery axis 34 to the bottom of the recess forming the first locking element 38 is denoted $R_{lock1}$, and a second distance from the battery axis 34 to the bottom of the recess forming the second locking element 42 is denoted $R_{lock2}$.

Figure 4:
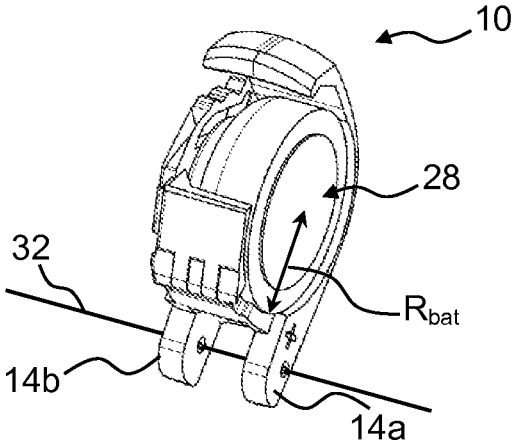
FIG. 4 illustrates a perspective view of an exemplary battery door with a battery, FIG. 5 schematically illustrates an exemplary hearing device according to some embodiments, with the battery door in an open position, FIG. 6 schematically illustrates an exemplary hearing device according to some embodiments, with the battery door in a first position, FIG. 7 schematically illustrates an exemplary hearing device according to some embodiments, with the battery door in a second position, FIG. 8 schematically illustrates an exemplary battery door according to some embodiments, FIG. 9 schematically illustrates an exemplary battery door according to some embodiments, and FIG. 10 schematically illustrates an exemplary battery door according to some embodiments.

FIG. 4 shows a perspective view of the battery door 10 with a battery 28 having a battery radius $R_{bat}$ inserted in the battery compartment 30. The at least one pivoting element of the battery door 10 comprises first pivoting element **14*a* and second pivoting element 14*b*** each having an opening for a pivot pin. The at least one pivoting element may be constructed as a single pivoting element or a plurality of pivoting elements.

Figure 5:
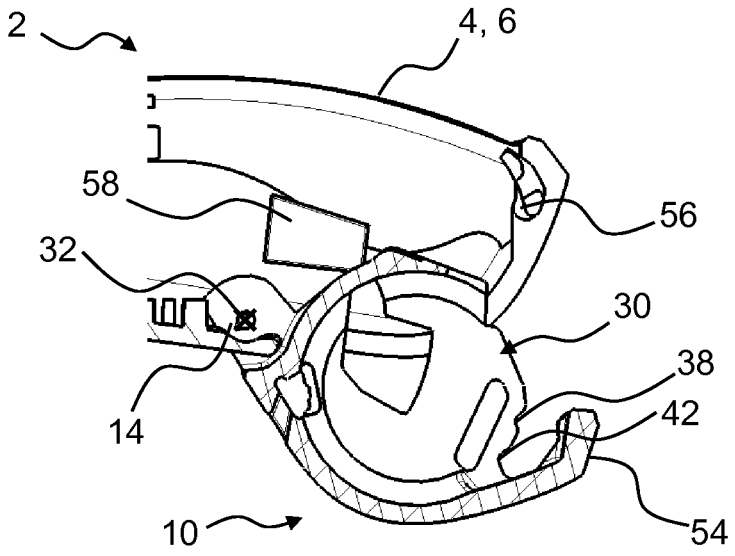
Figure 6:
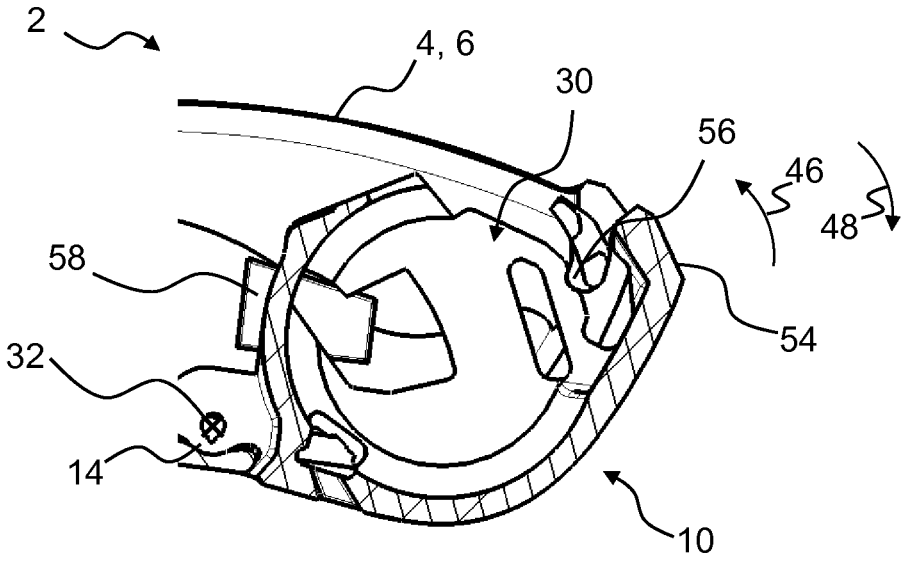
Figure 7:
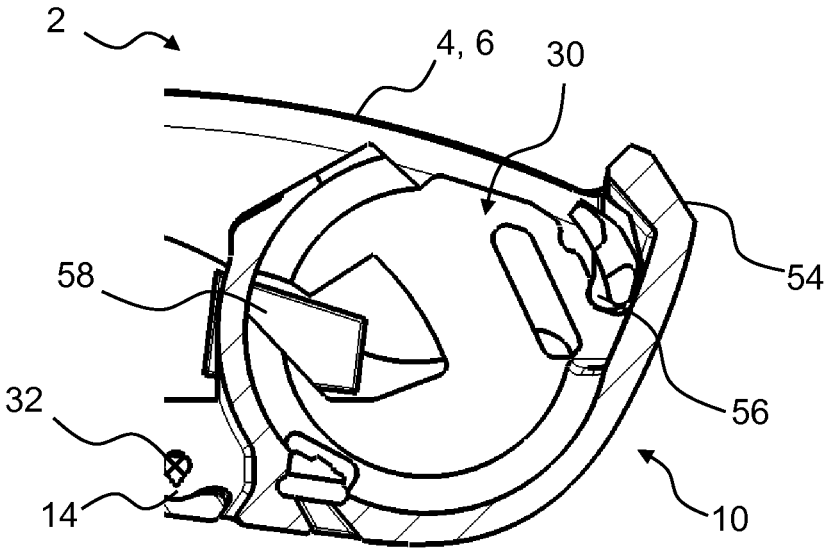

FIGS. 5-7 show an exemplary hearing device 2 comprising an exemplary battery door 10 in an open position, first position (OFF) and second position (ON), respectively. When the battery door 10 is rotated around the pivoting axis 32 in the closing direction 46, the battery door 10 will engage in the first position, as shown in FIG. 6, where an engagement member 56 of the housing 4, engages the first locking element 38. When a user rotates the battery door further in the closing direction 46, the battery door 10 will engage in the second position as shown in FIG. 7, where the engagement member 56 engages the second locking element 42. The first and second positions may be utilized as means for switching the hearing device off and on, thus having a first position where the hearing device is off and the battery door is nearly closed, thereby supporting and storing the battery and protecting the battery door from mechanical stress. When the battery door 10 is in the second position, an electrical connector 58 of the hearing device 2 will connect to the bottom part of a battery placed in the battery compartment through the first cutout. The battery bottom of a battery is the battery surface facing the bottom part of the battery door when the battery is inserted in the battery compartment.

Figure 8:
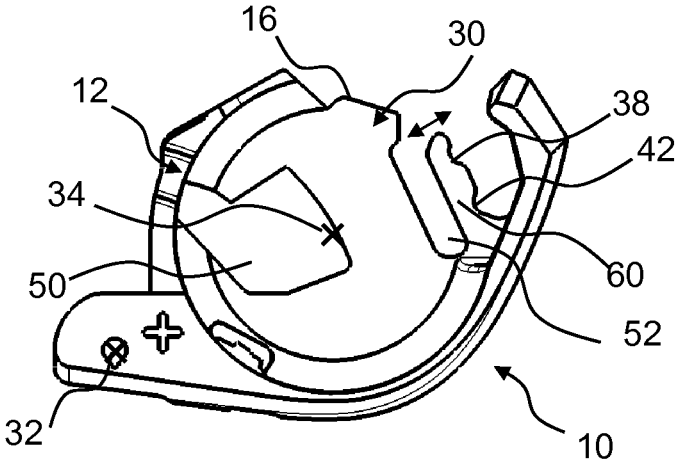

FIG. 8 shows an exemplary battery door, where the second cutout 52 is an open cutout, forming a first arm element 60 of the bottom part 16 pointing in the closing direction, wherein the first locking element 38 and the second locking element 42 are located. The first arm element flexes radially during opening and closing as indicated.

Figure 9:
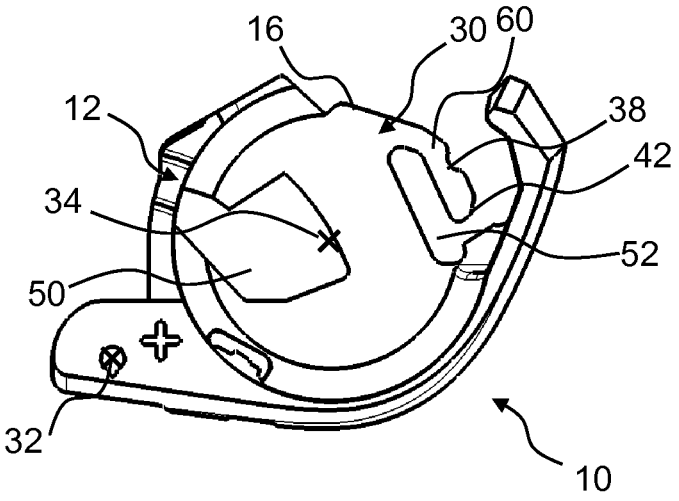

FIG. 9 shows an exemplary battery door, where the second cutout 52 is an open cutout, forming a first arm element 60 of the bottom part 16 pointing in the opening direction, wherein the first locking element 38 is located, and the opening of the second cutout 52 forms the second locking element 42.

Figure 10:
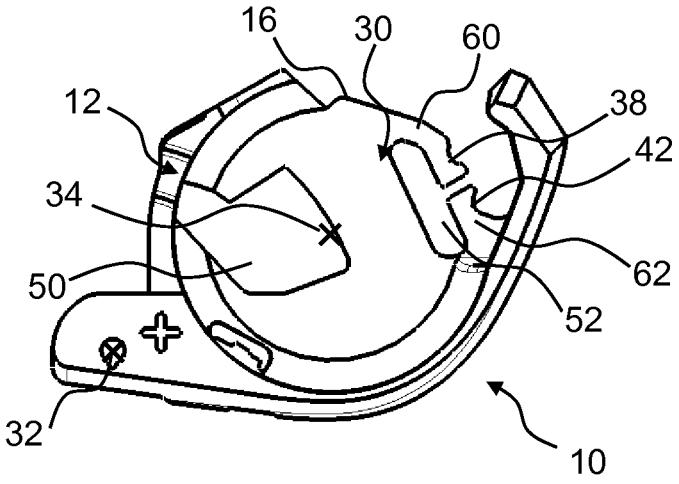

FIG. 10 shows an exemplary battery door according to some embodiments, where the second cutout 52 is an open cutout, and where the opening of the second cutout 52 is located between the first locking element 38 and the second locking element 42 forming a first arm element 60 and a second arm element 62 of the bottom part 16, wherein the first locking element 38 and the second locking element 42 are located on different arm elements.

Although particular embodiments have been shown and described, it will be understood that they are not intended to limit the claimed inventions, and it will be obvious to those skilled in the art that various changes and modifications may be made without departing from the scope of the claimed inventions. The specification and drawings are, accordingly, to be regarded in an illustrative rather than restrictive sense. The claimed inventions are intended to cover alternatives, modifications, and equivalents.

LIST OF REFERENCES

2 hearing device
4 housing

6 first housing part
10 battery door
12 body
14, 14*a*, 14*b* pivoting element
16 bottom part
18 sidewall
20 first bottom surface
22 first wall surface
24 second wall surface
26 contact points
28 battery
30 battery compartment
32 pivoting axis
34 battery axis
36 center axis
38 first locking element
40 first axis
42 second locking element
44 second axis
46 closing direction
48 opening direction
50 first cutout
52 second cutout
53 bridge element
54 handle element
56 engagement member
58 electrical connector
60 first arm element
62 second arm element
$R_{bat}$ battery radius
$R_1$ battery distance
$R_{lock1}$ first distance from battery axis to first locking element
$R_{lock2}$ second distance from battery axis to second locking element
$V_1$ first angle from the center axis to the first axis
$V_2$ second angle from the second axis to the center axis
$V_{12}$ third angle being the smallest angle between the second axis and the first axis.

The invention claimed is:

1. A hearing device comprising:
a hearing device housing; and
a battery door, wherein the battery door comprises:
a body with at least one connection for rotatably coupling the battery door to the hearing device housing such that the battery door is configured to pivot about a pivoting axis, the body having a bottom part and a sidewall, the bottom part having a first bottom surface and the sidewall having a first wall surface, the first wall surface comprising contact points for supporting a battery with a battery radius, wherein the first bottom surface and the first wall surface at least partly defines a battery compartment for housing the battery with a battery axis, wherein the contact points of the first wall surface are arranged at a battery distance from the battery axis, and wherein a center axis perpendicularly crosses the pivoting axis and crosses the battery axis;
a first locking element at the bottom part of the body; and
a second locking element at the bottom part of the body;
wherein the hearing device further comprises at least one engagement member configured to engage with the first and second locking elements of the battery door when the battery door is in a first and second position, respectively.

2. The hearing device according to claim 1, wherein the first locking element is at a first distance from the battery axis, the first distance being less than the battery distance.

3. The hearing device according to claim 2, wherein the second locking element is at a second distance from the battery axis, the second distance being less than the battery distance.

4. The hearing device according to claim 3, wherein the second distance is less than the first distance.

5. The hearing device according to claim 1, wherein the first locking element is arranged on a straight first axis perpendicularly crossing the pivoting axis, and the second locking element being arranged on a straight second axis perpendicularly crossing the pivoting axis, and wherein a first angle between the center axis and the first axis is anywhere from −20° to 20° and a second angle between the center axis and the second axis is anywhere from −20° to 20°.

6. The hearing device according to claim 5, wherein the first angle is anywhere from −10° to 10°, and the second angle is anywhere from −10° to 10°.

7. The hearing device according to claim 5, wherein the first angle is larger than 0°, and the second angle is less than 0°.

8. The hearing device according to claim 5, wherein an angle between the second axis and the first axis is anywhere from 5° to 20°.

9. The hearing device according to claim 1, wherein the first locking element comprises a first recess in the first bottom surface, the first recess extending radially inward.

10. The hearing device according to claim 9, wherein the second locking element comprises a second recess in the first bottom surface, the second recess extending radially inward.

11. The hearing device according to claim 1, wherein the bottom part has a first cutout section, the first cutout section extending to a second wall surface of the sidewall.

12. The hearing device according to claim 11, wherein the bottom part has a second cutout section.

13. The hearing device according to claim 1, wherein the bottom part comprises an arc-shaped bridge element, and the first locking element and the second locking element are at an outer edge of the bridge element.

14. The hearing device according to claim 1, wherein the bottom part comprises a first arm element, and the first locking element is at an outer edge of the first arm element.

15. The hearing device of claim 1, further comprising an electrical connector placed inside the hearing device housing, wherein the electrical connector is connectable to a bottom of the battery when the battery is placed in the battery compartment of the battery door and upon closing of the battery door.

* * * * *